United States Patent [19]

Wise et al.

[11] Patent Number: 4,976,371

[45] Date of Patent: Dec. 11, 1990

[54] RECEPTACLE LID SECURING DEVICE

[76] Inventors: Jeffrey A. Wise, 2525 Lake Dr.-R202, Singer Island, Fla. 33404; Charles E. Naperski, 13175 155th Pl., Jupiter, Fla. 33478

[21] Appl. No.: 394,129

[22] Filed: Aug. 15, 1989

[51] Int. Cl.[5] ..... B65D 45/00

[52] U.S. Cl. ..... 220/315; 220/319; 220/1 T; 292/258; 292/288

[58] Field of Search ..... 220/315, 319, 320, 85 CH, 220/1 T; 217/66, 81, 92; 4/253; 292/258, 256.65, 288, DIG. 11

[56] References Cited

U.S. PATENT DOCUMENTS

| | | | |
|---|---|---|---|
| 127,794 | 6/1872 | Ransom et al. | 292/288 |
| 1,372,812 | 3/1921 | Harmon | 292/288 X |
| 1,513,581 | 10/1924 | Caumont | 292/258 X |
| 2,128,693 | 8/1938 | Dowd | 217/66 X |
| 2,984,511 | 5/1961 | Hedrick | 292/258 |
| 3,124,381 | 3/1964 | Geldart | 292/258 |
| 3,363,924 | 1/1968 | Remiz | 292/258 |
| 3,589,760 | 6/1971 | Williams | 292/258 |
| 3,893,725 | 7/1975 | Coulter et al. | 292/258 |
| 4,009,897 | 3/1977 | Spellman | 292/258 |

*Primary Examiner*—Stephen Marcus
*Assistant Examiner*—Nova Stucker
*Attorney, Agent, or Firm*—Eckert Seamans Cherin & Mellott

[57] ABSTRACT

A lid securing device is provided for receptacles having a receptacle body and a receptacle lid. The lid securing device preferably includes at least one lid strap and a receptacle strap. The lid strap has a first engagement structure at least at one end thereof. The receptacle strap is adapted to circumferentially engage the receptacle body and has a second engagement structure. The first and second engagement structures are adapted to detachably engage ends of the lid strap to the receptacle strap. The receptacle strap and lid strap preferably are constructed from an elastic material, such that they can be securely stretched across the receptacle and receptacle lid, respectively.

15 Claims, 1 Drawing Sheet

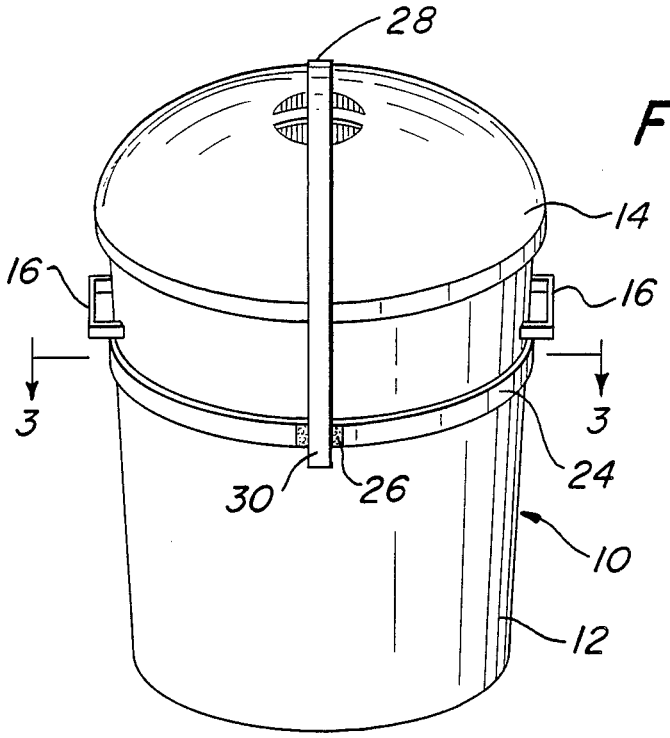
FIG. 1
FIG. 2
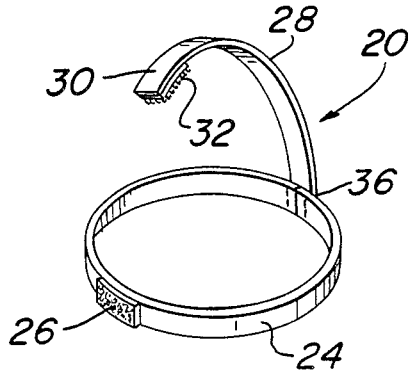
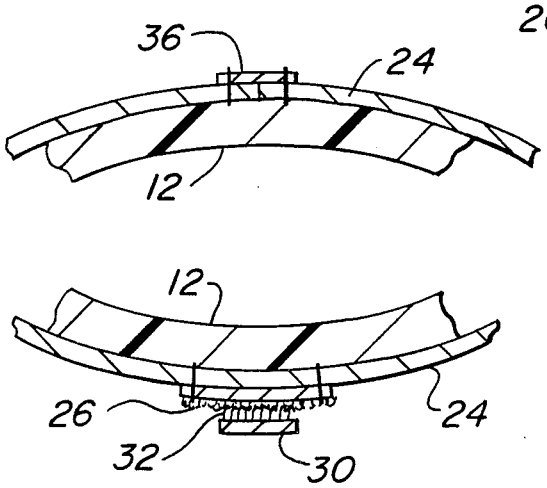
FIG. 3

RECEPTACLE LID SECURING DEVICE

BACKGROUND OF THE INVENTION

1. Field of the Invention

This invention relates generally to receptacles having a receptacle lid, and more particularly to a device for securing the receptacle lid to the receptacle body.

2. Description of the Prior Art

Most and particularly trash receptacles, have detach or light-weight lids, and because of the usually fit between the receptacle and its lid, the lid is easily removed by the wind or by small animals. The lid sometimes cannot be engaged to the receptacle because the receptacle is over-filled. Odor and spills are therefore a common problem.

Thus, it is desirable to have receptacles in which the lid is firmly secured to the receptacle. Several lid securing devices are presently in existence. Many of these can be engaged or disengaged only by the use of significant effort, which is a nuisance and can be difficult for older or handicapped individuals. Other securing devices are inadequate in terms of durability. Still other devices are designed for integral construction with the receptacle, and cannot be conveniently added to existing receptacles.

SUMMARY OF THE INVENTION

It is an object of the invention to provide a lid securing device for firmly retaining a receptacle lid to a receptacle body.

It is another object of the invention to provide a means for engaging a receptacle lid to a receptacle body which will be easy to manipulate.

It is still another object of the invention to provide a lid securing device which is durable.

It is yet another object of the invention to provide a lid securing device which can be utilized with existing receptacles.

These and other objects are accomplished by a lid securing device for receptacles having a receptacle body and a receptacle lid. The lid securing device preferably includes at least one lid strap and a receptacle strap. The lid strap has a first engagement structure at least at one end thereof. The receptacle strap is adapted to circumferentially engage the receptacle body and has a second engagement structure. The first and second engagement structures are adapted to detachably engage ends of the lid strap to the receptacle strap. Preferably, the lid strap has a fixed end affixed to one portion of the receptacle strap and a free end detachably engageable to another portion of the receptacle strap.

The free end of the lid strap is provided with a first engagement structure being adapted to detachably engage a second engagement structure which is affixed to the receptacle strap. The first and second engagement structures are preferably cooperating strips of hook and loop fasteners, such that they may be engaged and disengaged by the use of minimal force, but will securely retain the lid with the receptacle.

The lid securing device is adaptable to many kinds of receptacles and can be attached to these receptacle with very little effort. The receptacle strap needs only to be circumferentially fit around the receptacle body. The lid strap may then be securely tightened over the lid by stretching it until the first engagement structure can be engaged to the second engagement structure.

The receptacle strap and lid strap preferably are constructed from an elastic material, such that they can be tightly stretched around the receptacle and receptacle lid, respectively. An elastic receptacle strap allows the invention to be used with receptacles of several different sizes. An elastic lid strip also allows for receptacles of different dimensions, and further allows for securing lids to receptacles that have been over-filled.

BRIEF DESCRIPTION OF THE DRAWINGS

There are shown in the drawings embodiments which are presently preferred it being understood, however, that the invention is not limited to the precise arrangements and instrumentalities shown, wherein:

FIG. 1 is a perspective view of a receptacle and a lid securing device according to the invention in a first configuration.

FIG. 2 is a perspective view of the lid securing device in a second configuration.

FIG. 3 is a cross section taken along line 3—3 in FIG. 3, and partially broken away.

DETAILED DESCRIPTION OF THE PREFERRED EMBODIMENTS

A preferred receptacle assembly according to the invention is shown in FIG. 1, and a preferred lid securing device according to the invention is shown in detail in FIGS. 2 and 3. The receptacle assembly preferably includes a receptacle 10 of common construction with a receptacle body !2 and a receptacle lid 14. Carrying handles 16 are also sometimes provided. A lid securing device 20 is depicted of a size suited for use with the receptacle 10, although it will be appreciated that the particular size and configuration can take alternative forms when used with alternative receptacles. Accordingly, the size, configuration and manner of attachment of the lid securing device 20 to the receptacle can be varied to suit a particular receptacle.

The lid securing device 20 includes a receptacle engagement structure which is adapted to engage the receptacle body 12. The receptacle engagement structure is preferably a strap 24. The preferred embodiment of the receptacle strap 24 is a loop made from an elastic material which can be stretched to fit the circumference of the receptacle body 10. The receptacle strap 24 has a first engagement means 26. The lid securing device 20 also includes a lid strap 28 having a free end 30 and a second engagement means 32 affixed to the free end 30. The lid strap 28 preferably has a fixed end 36 which is affixed to the receptacle loop 24. The fixed end 36 can be fixed by suitable means such as stitching, staples, screws, glue or pressure heating.

The receptacle strap 24 and lid strap 28 would preferably be made from an elastic material, such as rubber, whereby each of the said straps can be stretched to fit any particular receptacle and lid. Also, the lid strap 24 can be stretched to secure a lid over a receptacle that has been over-filled. Other non-elastic materials can be used, including nylon, polyester, canvas and leather.

The first engagement means 26 and second engagement means 32 can be any of several suitable mechanisms which are adapted to detachably engage each other. A preferred engagement means is cooperating strips of hook and loop fasteners. Alternate engagement structure is also possible, such as a cooperating hook and eye portions, buckles, and snaps. The first and second engagement means can be affixed to the receptacle strap 24 and the lid strap 28, respectively, by any suitable means including staples, screws, glue and pressure heating.

The lid securing device 20 can be applied to the receptacle 10 by stretching the receptacle loop 24 and positioning it circumferentially about the receptacle body 12. The free end 30 of the lid strap 28 can then be stretched over the top of the lid 14 and towards the receptacle strap 24 until the first engagement means 26 can be engaged with the second engagement means 32. The receptacle body 12 is usually defined by a tubular shape, an open top end and a closed bottom end. Alternate receptacle constructions include substantially rectangular shapes. The lid securing device of the invention can be attached to receptacles with such alternative shapes and dimensions owing to the flexibility of the receptacle strap.

The receptacle strap 24 is preferably provided as a circular loop. In an alternative embodiment, the receptacle strap 24 can have opposing free ends, which can be secured to one another by suitable fastening means, such as a buckle or cooperating hook and loop fasteners, to circumferentially engage the receptacle body. In still another alternative embodiment, the receptacle engagement structure is attached to the receptacle body by adhesive tape or screws. In another alternate embodiment, the fixed end 36 of the lid strap 28 and the second engagement means 32 could be fixed directly to the receptacle body 12 at substantially opposite sides of the receptacle body 12.

This invention can be embodied in other forms without departing from the spirit or essential attributes thereof, and accordingly, reference should be had to the following claims, rather than to the foregoing specification, as indicating the scope of the invention.

I claim:

1. A lid securing device for securing a lid to a trash receptacle, said lid securing device comprising:

a lid strap, said lid strap having a first hooks-and-loops engagement means;

a receptacle loop adapted to circumferentially engage said trash receptacle, said receptacle look having a second hooks-and-loops engagement means, said first engagement means being adapted to engage said second engagement means, whereby said receptacle loop can be engaged to said trash receptacle and said lid strap can be engaged to said receptacle loop, such that said lid strap can be firmly fastened over said lid to retain said lid securely to said trash receptacle.

2. The lid securing device of claim 1, wherein said lid strap comprises a fixed end, said fixed end being affixed to said receptacle loop.

3. The lid securing device of claim 2, wherein said lid strap comprises a free end opposite to said fixed end, said free end comprising said first engagement means.

4. The lid securing device of claim 1, wherein said receptacle loop comprises an elastic material, whereby said receptacle loop can be stretched tightly around said trash receptacle to engage said receptacle loop to said receptacle and to hold said second engagement means firmly in place.

5. The lid securing device of claim 4, wherein said lid strap comprises an elastic material, whereby said lid strap can be tightened over said lid to retain said lid securely to said trash receptacle.

6. The lid securing device of claim 1, wherein said lid strap comprises an elastic material, whereby said lid strap can be tightened over said lid to retain said lid securely to said trash receptacle.

7. A trash receptacle assembly, said trash receptacle assembly comprising:

a trash receptacle body, said trash receptacle body having sides, a closed bottom end, and an open top end;

a trash receptacle lid, said trash receptacle lid having an area adapted to cover said open top end of said receptacle body;

a lid strap comprising an elastic material, and having a first engagement means;

a receptacle strap, said receptacle strap comprising a loop of an elastic material and having a second engagement means, said first engagement means being adapted to engage said second engagement means, whereby said receptacle strap can be stretched tightly around the circumference of said trash receptacle body and said lid strap can be firmly stretched over said lid and engaged to said receptacle strap to retain said lid securely to said trash receptacle body.

8. The receptacle assembly of claim 7, wherein said lid strap comprises a fixed end, said fixed end being affixed to said receptacle strap.

9. The receptacle assembly of claim 8, wherein said lid strap comprises a free end opposite to said fixed end, said free end comprising said first engagement means.

10. The receptacle assembly of claim 7, wherein said first engagement means and second engagement means comprise cooperating hook and loop fasteners.

11. A lid securing device for securing a lid to a trash receptacle, said lid securing device comprising;

a lid strap, said lid strap having a first engagement means;

a unitary receptacle loop comprising an elongated, planar, and elastic material, said receptacle loop being adapted to circumferentially engage said trash receptacle, said receptacle loop having a second engagement means, said first engagement means being adapted to engage said second engagement means, whereby said receptacle loop can be engaged to said trash receptacle and said lid strap can be engaged to said receptacle loop, such that said lid strap can be firmly fastened over said lid to retain said lid securely to said trash receptacle.

12. The lid securing device of claim 11, wherein said lid strap comprises a fixed end, said fixed end being affixed to said receptacle loop.

13. The lid securing device of claim 12, wherein said lid strap comprises a free end opposite to said fixed end, said free end comprising said first engagement means.

14. The lid securing device of claim 11, wherein said lid strap comprises an elastic material, whereby said lid strap can be tightened over said lid to retain said lid securely to said trash receptacle.

15. The lid securing device of claim 11, wherein said first engagement means and said second engagement means comprise cooperating hooks-and-loops fasteners.

* * * * *